US005287839A

United States Patent [19]

Kondou et al.

[11] Patent Number: 5,287,839

[45] Date of Patent: Feb. 22, 1994

[54] FUEL INJECTION EQUIPMENT FOR INTERNAL COMBUSTION ENGINE

[75] Inventors: Tetsuya Kondou, Shizuoka; Yutaka Inaba, Numazu; Narutoshi Aoki, Mishima; Yoshinobu Arakawa, Numazu; Ryuji Satsukawa, Shimizu; Tsuneaki Endou, Numazu, all of Japan

[73] Assignee: Kokusan Denki Co., Ltd., Japan

[21] Appl. No.: 814,714

[22] Filed: Dec. 30, 1991

[51] Int. Cl.[5] ..... F02D 41/04; F02D 41/26; F02M 39/00

[52] U.S. Cl. ..... 123/478; 123/490; 123/497

[58] Field of Search ..... 123/490, 497, 498, 499, 123/478

[56] References Cited

U.S. PATENT DOCUMENTS

| | | | |
|---|---|---|---|
| 3,502,895 | 3/1970 | Ballou | 123/497 |
| 3,587,545 | 6/1971 | Ballou | 123/497 |
| 3,815,556 | 6/1974 | Jaulmes | 123/490 |
| 3,817,225 | 6/1974 | Priegel | 123/497 |
| 3,969,614 | 7/1976 | Moyer et al. | 364/431.06 |
| 4,760,827 | 8/1988 | Schreiber et al. | 123/490 X |
| 5,161,496 | 11/1992 | Matsushima et al. | 123/478 X |

FOREIGN PATENT DOCUMENTS

| | | | |
|---|---|---|---|
| 59-122733 | 7/1984 | Japan . | |
| 59-122734 | 7/1984 | Japan . | |
| 63-93440 | 6/1988 | Japan . | |
| 63-170541 | 7/1988 | Japan . | |
| 63-259127 | 10/1988 | Japan . | |
| 3-934 | 1/1991 | Japan | 123/490 |

*Primary Examiner*—Willis R. Wolfe

*Attorney, Agent, or Firm*—Pearne, Gordon, McCoy & Granger

[57] ABSTRACT

A fuel injection equipment including a fuel injector for injecting fuel into a fuel injected space of an internal combustion engine and a fuel pump is disclosed. A generator which is driven by the internal combustion engine and has characteristics of being increased in output voltage or output current with an increase in engine rotation speed is used as any one of an injector driving power supply for feeding the fuel injector with an exciting current through an injector trigger circuit and a fuel pump driving power supply. Use of the generator as the power supply permits the fuel injection equipment to be controlled without requiring a complicated control circuit.

2 Claims, 5 Drawing Sheets

FUEL INJECTION EQUIPMENT FOR INTERNAL COMBUSTION ENGINE

BACKGROUND OF THE INVENTION

This invention relates to a fuel injection equipment for an internal combustion engine.

In Japanese Patent Application Laid-Open Publication No. 122733/1984 (59-122733) which discloses a conventional fuel injection equipment for an internal combustion engine, it is proposed to provide the fuel injection equipment with an electronic control system for permitting a fuel pressure applied to an injection nozzle for injecting fuel into an inlet pipe of an internal combustion engine to be controlled in proportion to an engine rotation speed by means of a control unit. More specifically, the control unit carries out an operation for increasing the fuel pressure in proportion to the engine rotation speed. An output of the control unit is input to a pump driving circuit, so that the pump driving circuit varies a delivery pressure of depending upon the output of the control unit, to thereby vary the fuel pressure. The actual fuel pressure is detected by a fuel pressure sensor, of which a detection signal is feed-backed to the control unit, to thereby control the fuel pressure.

Also, Japanese Patent Application Laid-Open Publication No. 122734/1984 (59-122734) proposes to provide a fuel injection equipment with an electronic control system for permitting a fuel pressure applied to an injection nozzle of a fuel injector to be controlled in proportion to an engine rotation speed by means of a control unit. In the fuel injection equipment disclosed in the publication, the fuel pressure is controlled by controlling an electronic control valve arranged in a fuel counterflow passage returned from a fuel pump to a fuel tank depending upon an output of the control unit while keeping a delivery pressure of the fuel pump.

In each of the conventional fuel injection equipments described above, a dynamic range of the fuel injector is apparently reduced to decrease an injection time lag of the fuel injector when an engine rotation speed is kept high. This permits the fuel injection equipment to readily accomplish an increase in the amount of fuel which is required at a high engine speed as well.

As described above, the prior art is so constructed that the fuel pressure is electronically controlled by means of the control unit. Unfortunately, such construction causes a complicated control means to be required for controlling the fuel pressure. Also, the electronic control by means of the control unit requires a stable power supply, so that it is required to use a battery as a control power supply. Thus, the conventional fuel injection equipment fails to be used for an internal combustion engine which does not use a battery as a control power supply.

SUMMARY OF THE INVENTION

The present invention has been made in view of the foregoing disadvantage of the prior art.

Accordingly, it is an object of the present invention to provide a fuel injection equipment for an internal combustion engine which is capable of being controlled without using any complicated control means.

It is another object of the present invention to provide a fuel injection equipment for an internal combustion engine which is capable of eliminating a necessity of using a battery as a control power supply.

In accordance with the present invention, a fuel injection equipment is provided which comprises a fuel injector including an exciting coil, a fuel pump for feeding fuel from a fuel tank to the fuel injector, a fuel pump driving power supply for driving the fuel pump, a driving power circuit, and an injector trigger circuit. The fuel injector injects fuel into a fuel injected space of an internal combustion engine when the exciting coil is fed with an exciting current of a predetermined level or more. The driving power circuit includes an injector driving power supply and generates a driving voltage applied to the exciting coil. The injector trigger circuit functions to permit the exciting current to be fed from the driving power circuit to the exciting coil of the fuel injector when an injection command signal is fed thereto. In the present invention, at least one of the fuel pump driving power supply and injector driving power supply comprises a generator driven by the internal combustion engine and having characteristics of being increased in output voltage or output current with an increase in engine rotation speed.

A time lag from application of the driving voltage to the exciting coil of the fuel injector to arrival of the exciting current at an injection starting level is reduced with an increase in driving voltage. Therefore, such an increase in driving voltage with an increase in driving voltage of the fuel injector as described above permits the injection time lag to be decreased with an increase in engine rotation speed, to thereby prevent a rate for which the injection time lag accounts in an injection available period at a high engine rotation speed from being increased, so that a demand for an increase in the amount of fuel to be injected may be readily satisfied at a high engine rotation speed as well. In particular, the present invention permits the fuel injector to be readily controlled with a simple construction that it is merely required to use a generator having specific output characteristics as a power supply while eliminating a necessity of using a battery as a control power supply.

An AC magneto is preferably used as the generator.

The generator may comprise an AC multipolar magneto including a generating coil for the fuel pump driving power supply and a generating coil for the injector driving power supply which are arranged separate from each other.

Also, in order to prevent the driving voltage from being excessively increased at a high engine rotation speed, a voltage regulator may be provided which functions to prevent a voltage applied across the exciting coil of the fuel injector from exceeding a predetermined level or value.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, a fuel injection equipment for an internal combustion engine according to the present invention will be described hereinafter with reference to the accompanying drawings.

Figure 1:
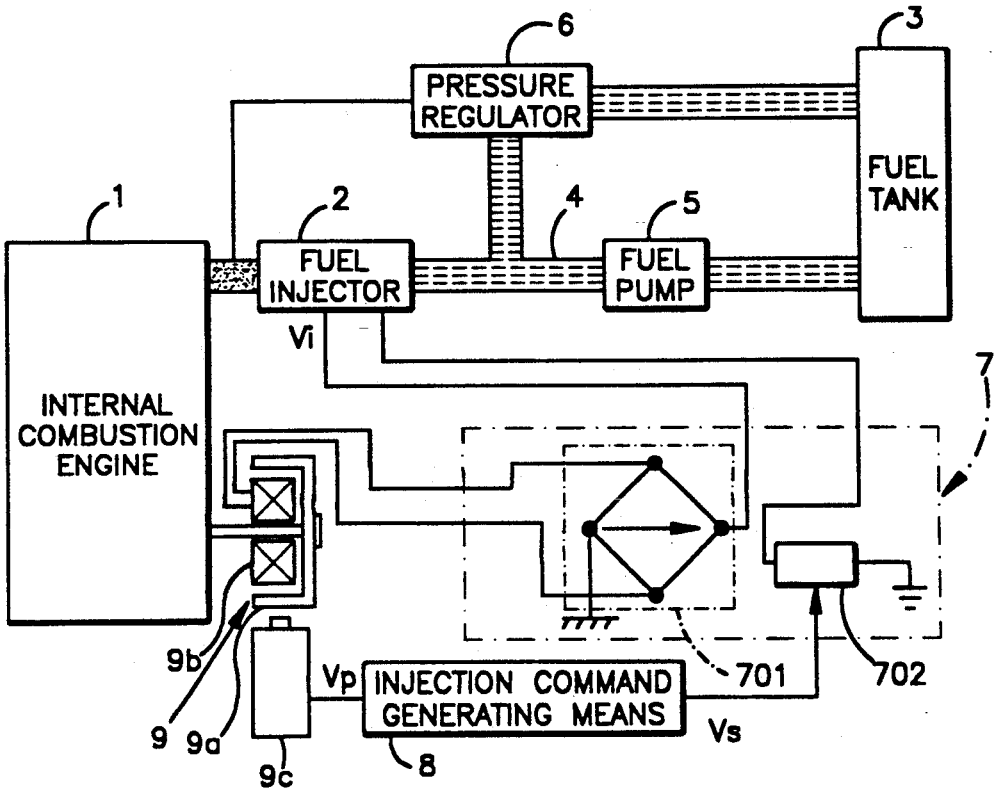
FIG. 1 is a block diagram showing an embodiment of a fuel injection equipment according to the present invention.
Figure 2:
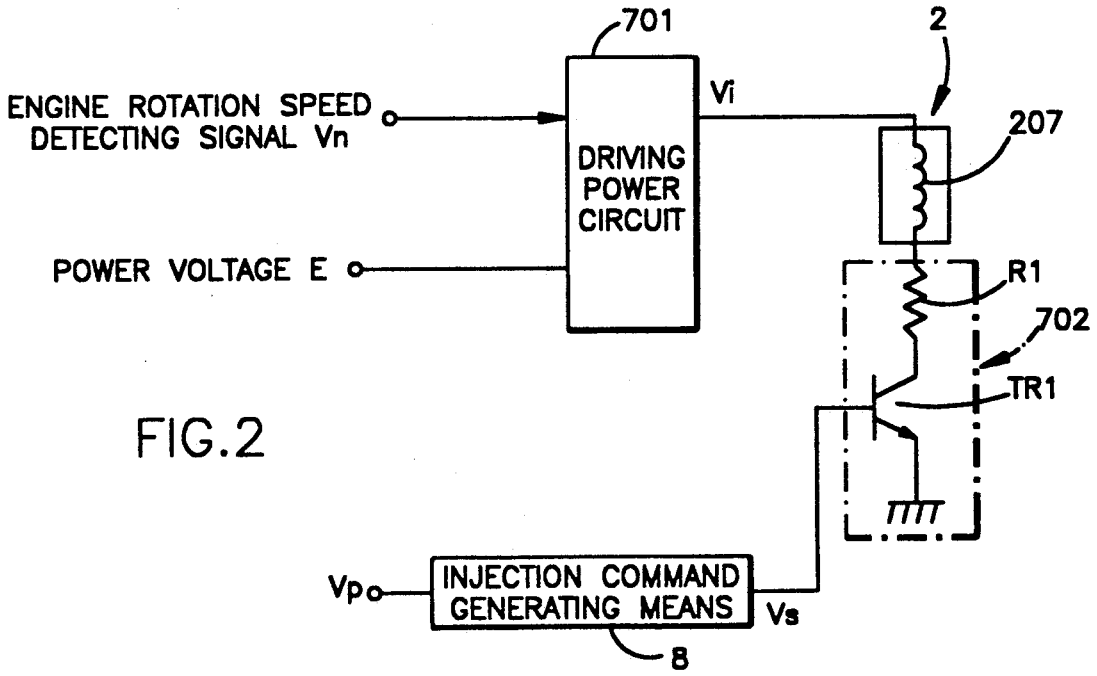
FIG. 2 is a block diagram showing an essential part of another embodiment of a fuel injection equipment according to the present invention.

Referring now to FIG. 1 schematically showing an embodiment of a fuel injection equipment according to the present invention, a fuel injection equipment of the illustrated embodiment includes a fuel injector 2 for injecting fuel into an inlet pipe (fuel injected space) of an internal combustion engine 1 when an injection command signal is fed thereto, a fuel pump 5 for pumping up fuel from a fuel tank 3 to forcibly feed it to a fuel feed pipe line 4 communicating with the fuel injector 2, and a pressure regulator 6 arranged between the fuel feed pipe line 4 and the fuel tank 3.

Reference numeral 7 designates an injector driving unit, which comprises a driving power circuit 701 functioning to generate a driving voltage applied to an exciting coil of the fuel injector and an injector trigger circuit 702 acting to feed an exciting current to the exciting coil of the fuel injector from the driving power circuit 701 when it is supplied with an injection command signal $V_s$. In the illustrated embodiment, the driving power circuit 701 comprises a full wave rectifier, across which an output of an AC magneto 9 mounted on an output shaft of the internal combustion engine 1 is applied.

The injector trigger circuit 702 comprises a switch kept turned on while the injection command signal $V_s$ is being fed thereto, so that a DC output voltage of the driving power circuit 701 is applied across the exciting coil of the fuel injector 2 during the "on" period of the switch.

The AC magneto 9 comprises a fly wheel magnet rotor 9*a* mounted on the output shaft of the internal combustion engine and a stator 9*b* mounted on a casing of the engine, so that an AC voltage induced across an armature winding of the stator 96 is applied across a rectifying circuit of the driving power circuit 701.

A fly wheel which constitutes a yoke of the rotor 9*a* of the AC magneto is provided on an outer periphery thereof with an inductor magnetic pole for signal generation, and a signal generating element 9*c* is arranged opposite to the magnetic pole. The magnetic pole on the outer periphery of the fly wheel and the signal generating element 9*c* cooperate with each other to form a signal generator, which functions to generate a pulse signal $V_p$ every time when the the magnetic pole on the outer periphery of the fly wheel is rendered opposite to the signal generating element 9*c* at a predetermined rotational angle position of the engine.

Reference numeral 8 indicates an injection command generating means, which is adapted to gain information on an engine rotation speed and information on an angle of rotation of the engine from the pulse signal $V_p$ to operate an injection starting position at each engine rotation speed, to thereby feed the injector trigger circuit 702 with the injection command signal $V_s$ of a predetermined time width at each of the injection starting positions.

Figure 3:
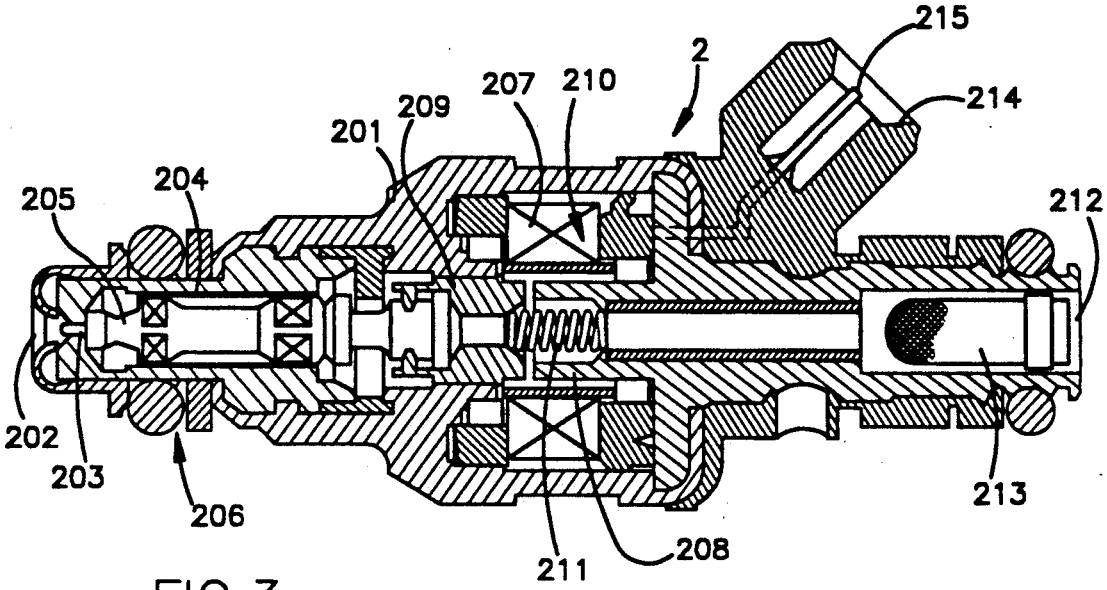
FIG. 3 is a sectional view exemplifying a structure of a fuel injector which may be used for the present invention.

Now, referring to FIG. 3 showing an example of the fuel injector 2, 201 designates an injector body, on one end of which a needle valve 206 is mounted. The needle valve 206 comprises a valve body 204 including a valve seat 203 arranged so as to surround an injection port 202 and a needle 205 provided in the valve body 204 for operating the injection port 202. In the injector body 201 is arranged an electromagnet 210 which comprises an exciting coil 207, an iron core 208 and an armature 209 adapted to be sucked on the iron core 208. The armature 209 is connected to the needle 205. The injector body 210 is also provided therein with a reset coil 211, which serves to constantly force the needle 205 in a direction of closing the injection port 202. The injector body 201 is provided on the other end thereof with a fuel inlet 212, on which a filter 213 is mounted. In addition, the injector body 201 is mounted thereon with a connector 214 having a terminal 215, so that electrical supply is carried out through the terminal 215 to the coil 207.

The fuel injector 2 constructed as described above may be mounted on, for example, the inlet pipe of the engine in such a manner that the injection port 202 is oriented into the inlet pipe (fuel injected space). The inlet 212 of the fuel injector 2 is connected through a piping 4 to a delivery port of the fuel pump 5, to thereby permit fuel to be fed to the inlet 212 under a predetermined fuel pressure. Also, to the connector 214 is connected a cable (not shown), through which the connector 214 is connected to the injector driving unit 7.

When a driving voltage $V_i$ is applied from the injector driving unit 7 to the exciting coil 207, the iron core 208 is excited, so that the armature 209 is sucked on the iron core 208. This causes the needle 205 to move toward the electromagnet side, leading to opening of the needle valve 206, so that fuel may be injected from the injection port 202 in the form of mist into the inlet pipe. When the injection command signal is extinguished, the coil 207 is de-energized, so that the reset coil 211 returns the needle 205 to a position of causing the injection port 202 to be closed.

In the illustrated embodiment, when the injection command signal is generated from the injection command generating means 8, the switch of the injector trigger circuit 702 is turned on to cause the output voltage of the driving power circuit 701 acting as a driving voltage to be applied across the exciting coil of the fuel injector. This causes an exciting current $I_{ij}$ to flow through the exciting coil of the fuel injector. Then, when the current reaches a predetermined injection starting level $I_{on}$, the needle valve of the fuel injector is rendered open to permit injection of fuel to be started. When the injection command signal is extinguished, the switch of the injector trigger circuit 702 is made interrupted, so that the exciting current of the fuel injector is rendered zero, resulting in the needle valve being closed to stop the injection of fuel.

Figure 4:
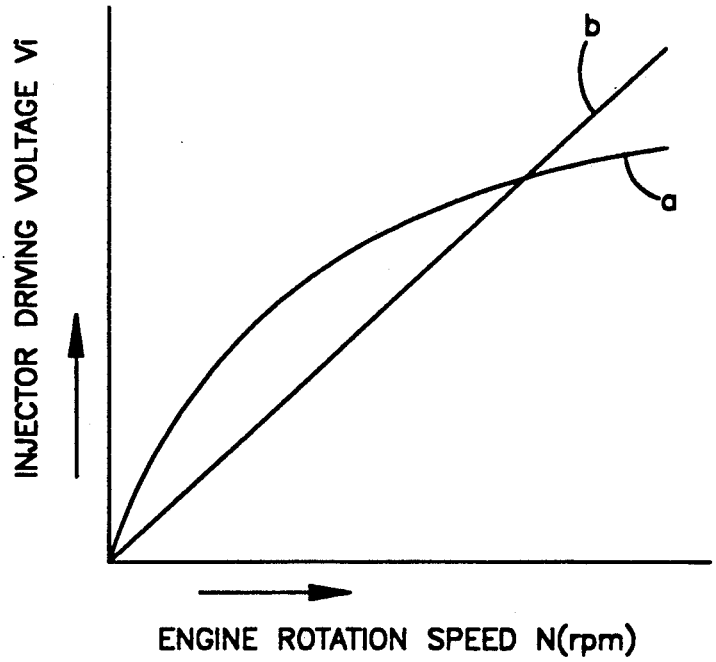
FIG. 4 is a graphical representation exemplifying a relationship between a driving voltage of a fuel injector and an engine rotation speed.

When such a generator driven by the internal combustion engine is used as the driving power circuit 701 of the injector driving unit 7, the driving voltage $V_i$ of the fuel injector is increased with an increase in engine rotation speed N. Characteristics of a variation of the driving voltage $V_i$ with respect to the engine rotation speed N are as indicated a curve a in FIG. 4.

Such an increase in driving voltage of the fuel injector with an increase in engine rotation speed permits an injection time lag of the fuel injector to be reduced with an increase in engine rotation speed.

Figure 5:
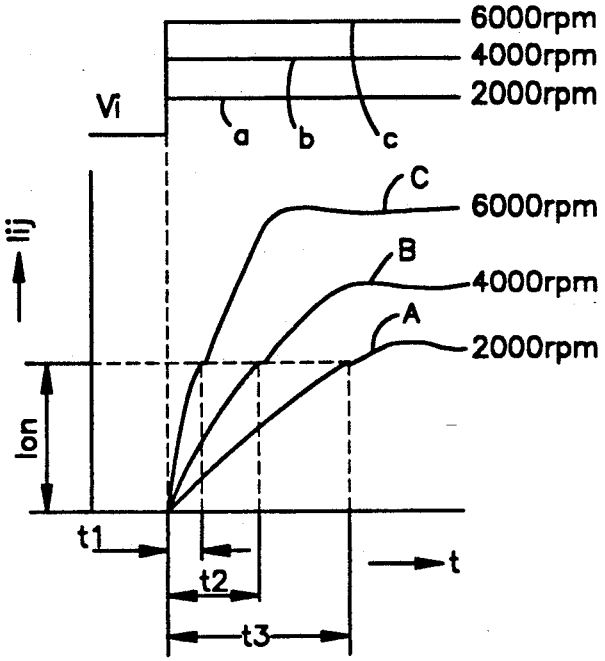
FIG. 5 is a waveform showing a relationship between a driving voltage of a fuel injector and its exciting current.
Figure 6:
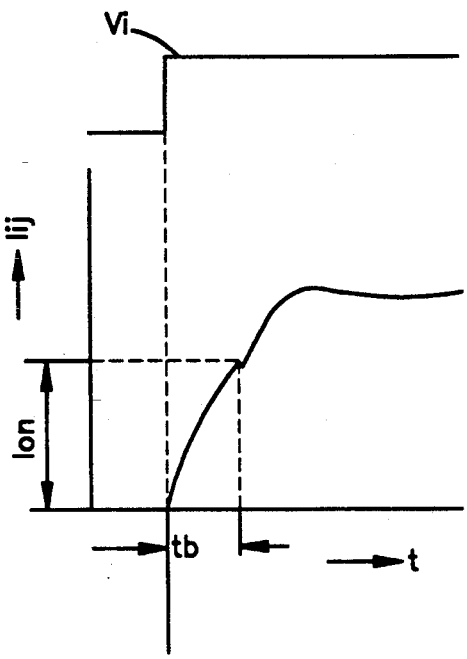
FIG.6 (PRIOR ART)
FIG. 6 is a waveform showing a relationship between a driving voltage of a fuel injector and its exciting current in a conventional fuel injection equipment.
Figure 7:
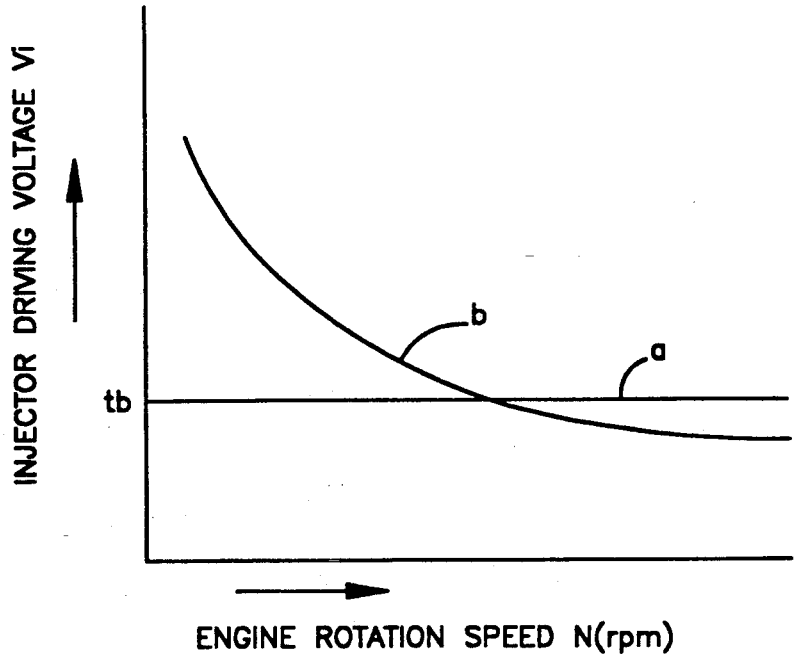
FIG. 7 is a graphical representation showing an injection time lag and en engine rotation speed.

For example, supposing that the driving voltages respectively exhibited when the engine rotation speeds N are 2,000 rpm, 4000 rpm and 6000 rpm are as indicated at reference characters a, b and c in FIG. 5, exciting currents $I_{ij}$ flowing through the exciting coil of the fuel injector are as indicated at curves A, B and C in FIG. 5; so that a time lag from feeding of the injection command signal to arrival of the exciting current $I_{ij}$ at the injection starting level which permits the fuel injection to be actually started is reduced as indicated at t3, t2 and t1 in turn with an increase in engine rotation speed. Thus, characteristics of the time lag to the engine rotation speed N is as indicated at a curve b in FIG. 7.

Such an increase in driving voltage of the fuel injector with an increase in engine rotation speed as described above permits the injection time lag to be decreased with an increase in engine rotation speed, to thereby prevent a rate for which the injection time lag accounts in an injection available period from being increased, so that a demand for an increase in the amount of fuel to be injected is effectively satisfied at a high engine rotation speed as well.

In the illustrated embodiment, in order to prevent a voltage applied across the exciting coil of the fuel injector at a high engine rotation speed from being excessively increased, a voltage regulator may be connected to, for example, an output side of the driving power circuit 701 to prevent the driving voltage from exceeding a predetermined value or level. As the voltage regulator may be used a circuit (switch circuit) which is constructed so as to detect a voltage across the exciting coil of the fuel injector, to thereby short-circuit the output of the rectifier when the detected voltage exceeds the predetermined value. Alternatively, a circuit (switch circuit) which is constructed so as to prevent the output of the rectifier from being applied to the fuel injector may be used for this purpose.

The illustrated embodiment is so constructed that the fuel pump 5 is driven by means of the output of the magneto 9 driven by the internal combustion engine. For this purpose, a multipolar magneto of which a stator includes a generating coil for driving the fuel injector and a generating coil for driving the fuel pump which are arranged separate from each other is preferably used as the magneto 9. The construction of the illustrated embodiment that the fuel pump 5 is driven by the magneto 9 permits the driving voltage of the fuel pump to be increased with an increase in engine rotation speed, leading to an increase in delivery pressure of the fuel pump, so that the fuel pressure applied to the inlet of the fuel injector 2 may be increased with an increase in engine rotation speed. Such a variation in fuel pressure depending upon the engine rotation speed can eliminate a necessity of arranging a path for returning fuel through the pressure regulator 6 to the fuel tank 3.

The amount of fuel injected from the fuel injector per unit time is increased with an increase in fuel pressure, therefore, such an increase in fuel pressure with an increase in engine rotation speed as described above leads to an increase in the amount of injected fuel per unit time at a high engine rotation speed, so that an increase in feed rate of fuel may be accomplished even at a high engine rotation speed at which the injection available period is reduced.

The amount of injected fuel per unit time is decreased at a low engine rotation speed, therefore, excessive feed of fuel at a low engine rotation speed is prevented.

In the embodiment shown in FIG. 1, an AC magneto is used as the magneto 9. However, a DC magneto may be used for this purpose.

Figure 8:
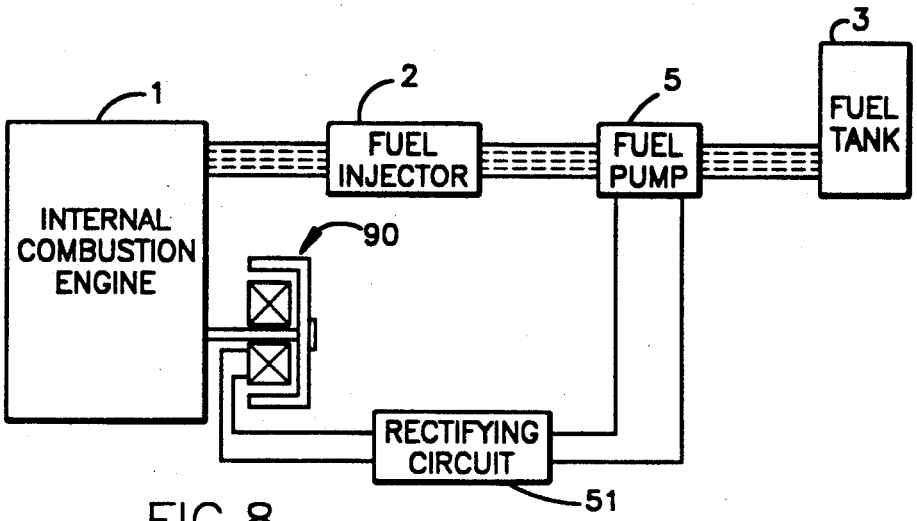
FIGS. 8 and 9 each are a block diagram showing a further embodiment of a fuel injection equipment according to the present invention.

FIG. 8 shows another embodiment of a fuel injection equipment according to the present invention. In the illustrated embodiment, a generator 90 is mounted on an output shaft of an internal combustion engine 1 and an output of the generator 90 is applied through a rectifying circuit 91 to a power terminal of a fuel pump 5. As a power supply (not shown) of a fuel injector is used a power supply including a rectifying circuit for rectifying an output of a generating coil of the generator 90 as in the embodiment shown in FIG. 1. In the illustrated embodiment, the fuel pump 5 comprises a pump exhibiting characteristics of permitting a delivery pressure of the pump to be varied depending upon its driving voltage or exciting current.

Figure 10:
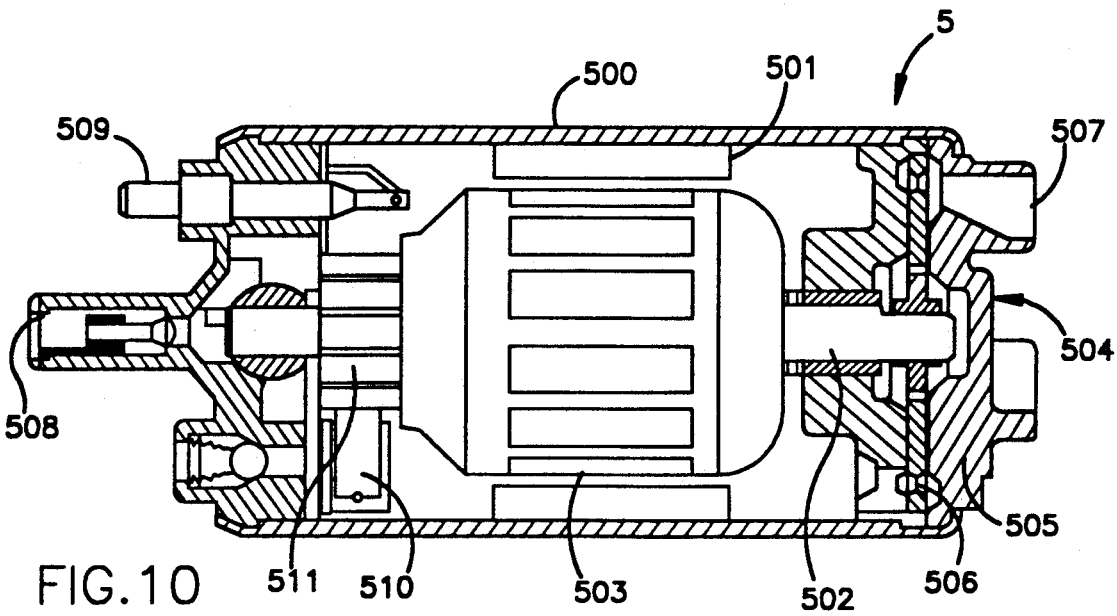
FIG. 10 is a sectional view exemplifying a structure of a fuel pump.

FIG. 10 shows an example of the fuel pump 5 which may be used for the embodiment of FIG. 8. A fuel pump 5 exemplified in FIG. 10 comprises a DC motor including a stator side magnet 501 provided in a housing 500, a rotor 503 mounted on a revolving shaft 502 supported through a bearing in the housing 500 and a pump 504 driven by a motor arranged on one end side of the housing 500. The pump 504 comprises a pump casing 505 and an impeller 506 arranged in the casing 505, wherein the impeller 506 is joined to the revolving shaft 502. The casing 505 of the pump 504 is provided on one end thereof with an inlet port 507 and the housing 500 is provided on the other end side thereof with a delivery port 508. Also, the housing 500 is provided on the other end side thereof with a feed terminal 509, from which electrical supply is carried out through a brush 510 and a rectifier 511 to a winding of the rotor 503.

The fuel pump is arranged in a fuel tank and the inlet port 507 is inserted into fuel. The delivery port 508 is connected through a piping (not shown) to the fuel injector 2.

Electrical feed to the rotor 503 of the fuel pump 5 causes the rotor to revolve to rotate the impeller. This leads to introduction of fuel through the inlet port 507. The introduced fuel is fed through the housing 500 and delivered from the delivery port 508. A delivery pressure of the fuel pump is increased with an increase in voltage applied to the rotor.

Figure 11:
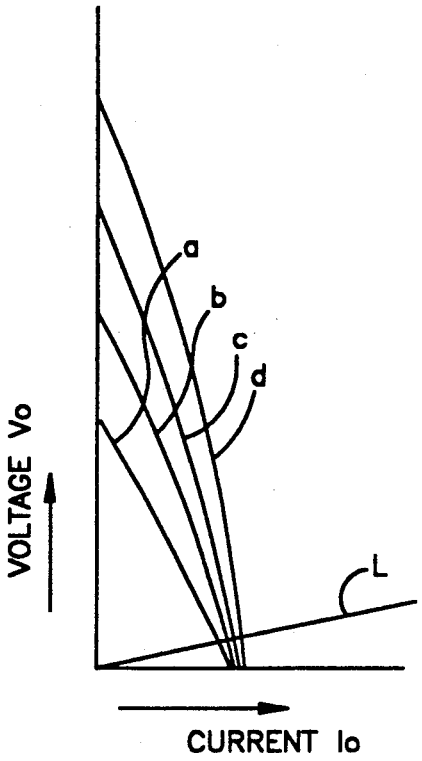
FIGS. 11 and 12 each are a graphical representation showing different characteristics of a generator which may be used for the present invention.
Figure 12:
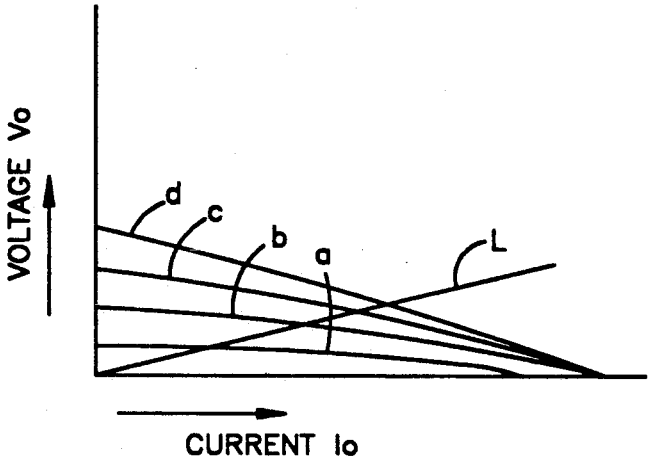

The generator 90 may comprise, for example, an AC magneto. Use of the AC magneto as the generator 90 causes its output voltage $V_0$-to-output current $I_0$ characteristics to be, for example, as shown in FIGS. 11 and 12, wherein curves a to d indicate characteristics of the magneto at different engine rotation speeds, respectively. It will be noted that the engine rotation speed N is increased in order of a, b, c and d.

Figure 13:
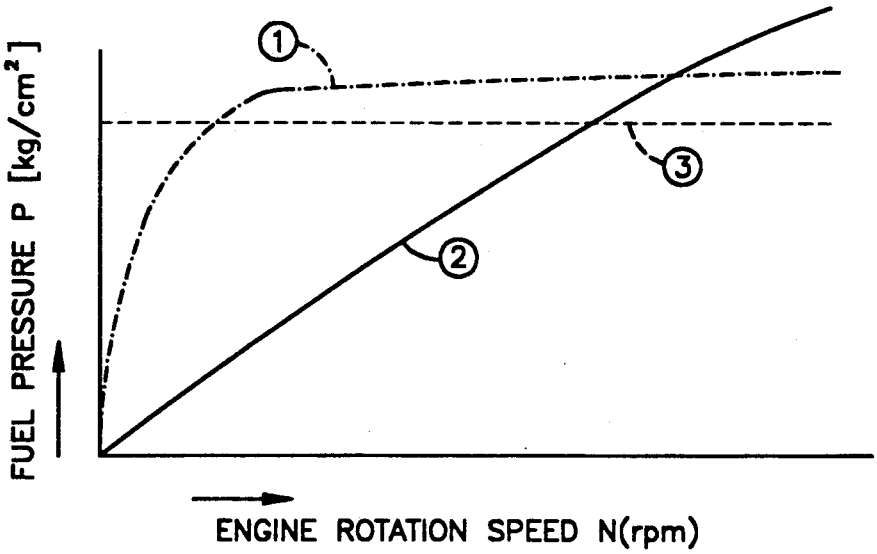
FIG. 13 is a graphical representation showing characteristics of an engine rotation speed to a fuel pressure which are obtained by the fuel injection equipment shown in FIG. 8.

Use of the generator 90 exhibiting such characteristics as shown in FIG. 11 in the embodiment of FIG. 8 causes a relationship between a generator rotation speed (engine rotation speed) N and a fuel pressure is as indicated at a curve 1 in FIG. 13, supposing that load characteristics of the fuel pump (a relationship between its input voltage and its input current) is indicated at L. More specifically, the fuel pressure P is rapidly increased in a region in which the engine rotation speed is kept relatively low and then settled to be nearly constant. In this instance, the fuel pressure is increased with an increase in engine rotation speed only in the relative low engine rotation speed region and settled to be nearly constant in an engine rotation speed region of a predetermined level or above.

The illustrated embodiment may be constructed in such a manner that a pressure regulator is arranged between a pipe line between the fuel pump and the fuel injector and the fuel tank, to thereby return a part of fuel to the fuel tank through the pressure regulator when the fuel pressure of the engine is at a predetermined level or more, resulting in the fuel pressure being kept at the engine rotation speed region of the predetermined level or above, as in the embodiment of FIG. 1. Such construction permits the fuel pressure to be increased with an increase in engine rotation speed in the engine rotation speed region of the predetermined level or below and rendered substantially constant in the region exceeding the predetermined level.

When the generator 90 having such characteristics as shown in FIG. 12 is used, the fuel pressure P is linearly increased with respect to the engine rotation speed N, as indicated at a curve 2 in FIG. 13. In FIG. 13, a curve 3 indicates characteristics of the conventional fuel injection equipment in which a fuel pressure is controlled to be constant.

Alternatively, the embodiment of FIG. 8 may be provided with a voltage regulator which controls so as to prevent a voltage applied to the fuel pump on an output side of the generator from exceeding the predetermined level or value. Such arrangement of the voltage regulator likewise results in the fuel pressure being increased with an increase in engine rotation speed in the engine rotation speed region of the predetermined level or below and rendered substantially constant in the region exceeding the predetermined level.

The illustrated embodiment uses the generator which is increased in output voltage with an increase in engine rotation speed, to thereby permit the output of the fuel pump to be increased with an increase in engine rotation speed. However, the same results may be obtained also when a generator having characteristics of being increased in output current with an increase in engine rotation speed is used.

Further, the illustrated embodiment uses an AC generator as the generator 90. However, a DC generator may be used for this purpose, wherein the rectifier is eliminated.

When an AC generator is used as the generator 90 in the embodiment of FIG. 8, an AC motor may be used as a motor for driving the fuel pump free of any brush. In this instance, the rectifying circuit 51 is eliminated. In particular, driving of the fuel pump by a motor free of a brush when the fuel pump is positioned in the fuel tank prevents generation of spark, to thereby significantly improve safety.

Figure 9:
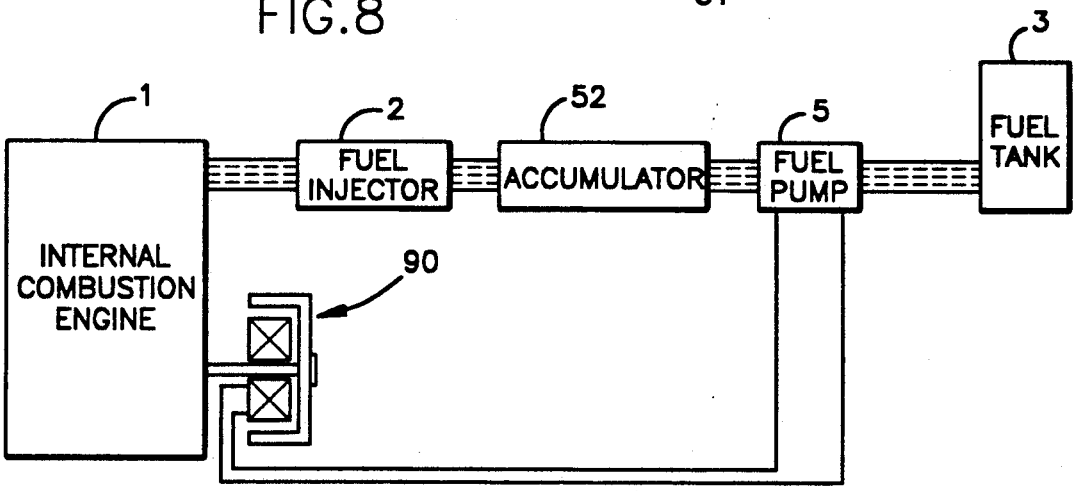

FIG. 9 shows a further embodiment of a fuel injection equipment according to the present invention, which is constructed in such a manner that an accumulator 52 is provided between a fuel pump 5 and a fuel injector 2. Such construction permits fuel of a predetermined pressure fed from the fuel pump 5 to be stored in the accumulator 52, which is then fed therefrom to the fuel injector 2. The remaining part of the embodiment may be constructed in substantially the same manner as the embodiment described above with reference to FIG. 8.

The construction that the fuel pump 5 is driven by means of an output of the generator 90 when the engine is subject to manual starting operation or kick starting operation often fails to start the engine, because it fails to increase the fuel pressure to a predetermined level by one starting operation when the starting operation is carried out under a fuel pressure of a zero level. Arrangement of the accumulator 52 between the fuel pump and the fuel injector permits a fuel pressure generated by the starting operation to be stored in the accumulator 52, so that repeating of the starting operation increases the fuel pressure to the predetermined level to accomplish starting of the engine even when the starting operation is carried out under the fuel pressure of a zero level.

Also, arrangement of the accumulator 52 allows a pressure in the accumulator 52 to be used to apply a residual pressure to the fuel injector when the engine is stopped, so that a fuel pressure of the fuel injector required for the next starting of the engine is positively ensured, to thereby facilitate the starting of the engine.

The embodiments shown in FIGS. 8 and 9 each are not provided with a path for returning a part of fuel flowing through the fuel supply system to the fuel tank 3. However, it is a matter of course that the embodiments each may be provided with a path for returning, to the fuel tank, a part of fuel flowing between the fuel pump and the fuel injector in order to prevent an increase in temperature of fuel fed to the fuel injector. Also, the embodiments each may be loaded with a pressure regulator, so that the fuel pressure may be prevented from being increased to a level of a predetermined level or more or an upper limit of the fuel pressure may be set.

The above described arrangement of each of the fuel pump, fuel injector and pressure regulator is should be merely understood as an example, therefore, the present invention is not limited to such arrangement.

Further, each of the embodiments described above uses, as one of the injector driving power supply and fuel pump driving power supply, the AC generator having characteristics of being increased in output voltage or output current with an increase in engine rotation speed. However, it is a matter of course that such an AC generator (generating coil) may be used for each of both injector driving power supply and fuel pump driving power supply. In this instance, desired fuel pressure characteristics may be ensured by a combination of output characteristics of the generating coil for the injector driving power supply and those of the generating coil for the fuel pump driving power supply.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fuel injection equipment in combination with an internal combustion engine which does not have a battery serving as a control power supply comprising:

a fuel injector including an exciting coil and injecting fuel into a fuel injected space of an internal combustion engine when said exciting coil is fed with an exciting current of a predetermined level or more;

a fuel pump for feeding fuel from a fuel tank to said fuel injector;

a fuel pump driving power supply for driving said fuel pump;

a driving power circuit including an injector driving power supply and generating a driving voltage applied to said exciting coil; and an injector trigger circuit for permitting said exciting current to be fed from said driving power circuit to said exciting coil of said fuel injector when an injection command signal is fed thereto;

said fuel pump driving power supply and injector driving power supply comprising a magneto driven by said internal combustion engine and having characteristics of being increased in output voltage or output current with an increase in engine rotation speed;

said magneto comprising an AC multipolar magneto including a generating coil for said fuel pump driving power supply and a generating coil for said injector driving power supply which are arranged separate from each other.

2. A fuel injection equipment as defined in claim 1, wherein said driving power circuit includes a voltage regulator which prevents said driving voltage from being excessively increased when the engine rotation speed is at a high level.

* * * * *